United States Patent [19]

Bichet

[11] 4,437,921

[45] Mar. 20, 1984

[54] PRESS FOR GLUING FOOTWEAR ELEMENTS

[75] Inventor: Lucien Bichet, Dravel, France

[73] Assignee: Anver S.A., Maisons-Alfort, France

[21] Appl. No.: 440,727

[22] Filed: Nov. 10, 1982

[30] Foreign Application Priority Data

Nov. 25, 1981 [FR] France ..... 81 22024

[51] Int. Cl.[3] ..... B30B 15/00

[52] U.S. Cl. ..... 156/475; 100/211; 156/580; 156/583.3

[58] Field of Search ..... 156/212, 475, 493, 580, 156/583.3, 583.91, 73.6; 100/211

[56] References Cited

U.S. PATENT DOCUMENTS

| | | | |
|---|---|---|---|
| 2,236,552 | 4/1941 | Ushakoff | 156/583.3 |
| 2,654,901 | 10/1953 | Morrison | 100/211 |
| 2,698,273 | 12/1954 | Miner et al. | 156/583.3 |
| 3,533,352 | 10/1970 | Miller | 156/583.3 |

*Primary Examiner*—Michael G. Wityshyn
*Attorney, Agent, or Firm*—Browdy and Neimark

[57] ABSTRACT

A press for gluing footwear elements to each other comprising a tank and means for supporting an article of footwear in the tank. A flexible pocket or elastic membrane is positioned in the tank and is adapted to envelope at least the portion of the article of footwear which includes the footwear elements which are to be glued to each other. The press includes a jack having a cylinder and a piston movable in the cylinder, the piston being adapted to be moved by the application of a pressurized pneumatic fluid to one surface of the piston. The opposite surface of the piston communicates with a liquid supply in the tank, whereby movement of the piston is operable to force the liquid under pressure against the flexible pocket or elastic membrane to cause the flexible pocket to conform to the contour of the footwear elements whereby to cause the elements to become glued to each other. Means is provided for moving the piston to a retracted position when the pneumatic pressure is released. This means for causing the piston to move to a retracted position may comprise a cross member connected to a portion of the piston rod which projects beyond the cylinder and spring means engageable with the cross member for normally biasing the piston and the piston rod to a retracted position.

9 Claims, 3 Drawing Figures

PRESS FOR GLUING FOOTWEAR ELEMENTS

FIELD OF INVENTION

This invention relates to presses for gluing footwear or other leather articles, in which an elastic membrane or pocket acts as the pressure means between the glued sole and the mounted upper or body of the footwear. The invention relates more particularly to improvements in gluing presses operated by fluid pressure.

DESCRIPTION OF THE PRIOR ART

For a long time, presses for footwear have been known which comprise in a rigid, undeformable enclosure, a flexible, impermeable membrane which, by exerting a hydraulic or pneumatic pressure around the footwear, is applied exactly to contours of the elements to be glued that have been introduced into this pocket (Pic press, French Pat. No. 1,035,989 of Apr. 20, 1951).

Over the years, these presses have undergone numerous improvements and various adaptations, for example, for gluing knee-high boots (French Pat. Nos. 79,27634 of Nov. 9, 1979; 81.08962 of June 5, 1981).

In the majority of machines of this type, the pressurized fluid which acts to apply the flexible pocket/or membrane around the footwear elements, consists of water, and the frame of the machine has a costly group of elements and devices intended to provide the hydraulic pressure and circuit, in particular: pump, motor, fan, radiator, various valves and numerous pipes. The amount of water used is rather large and it is necessary constantly to maintain its pressure in most of the hydraulic circuit. Further, the times required for filling and emptying the water tank containing the flexible pocket are considerable since they generally are on the order of 12 to 18 seconds on the average.

STATEMENT OF THE INVENTION

It has now been found that by modifying the principle of putting the fluid under pressure it is possible to avoid the above drawbacks and particularly to simplify the hydraulic system considerably and reduce to a negligible period the operations of filling and emptying the containers in which the flexible pocket works.

According to the essential characteristic of the invention, said hydraulic system, enclosed in the press frame, is replaced with a hydropneumatic device consisting of a jack whose piston is operated by injection of pressurized air which the normally upper end of the piston communicates with a tank containing the flexible pocket and containing a small amount of water and drives the water against the pocket and footwear; the piston rod has secured thereto a plate moving vertically between spring means that automatically brings the jack back to the low position as soon as the air pressure is released.

Other characteristics will come out in the following detailed description, relating to a nonlimiting embodiment, shown in the accompanying diagrammatic drawings.

DESCRIPTION OF THE PREFERRED EMBODIMENT

Figure 1:
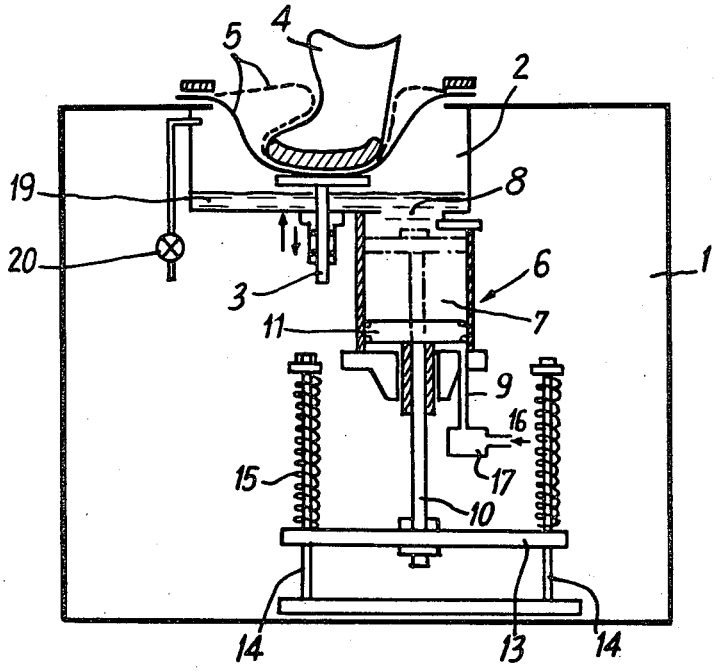
FIG. 1 is a simplified view in vertical section of the gluing press according to the invention.

In the upper part of frame 1 can be seen the structure of presses that are already known (for example, that of the applicant, in French patent application No. 81.08962) with a tank 2 containing the support of last 3 of footwear 4 and flexible pocket 5 which acts as the means for applying pressure to the glued elements of the footwear. The shaper or shapers for holding the footwear during gluing have not been shown here for simplification. In practice, the press is generally provided with two stations (therefore two tanks) to work on a pair of footwear. The side view of FIG. 1 shows only one tank.

According to the invention, all of the known devices of the hydraulic system, usually used for putting fluid under pressure (for example, water and oil soluble under 2 to 11 bars) have been replaced by a device essentially comprising a jack 6 having a chamber 7, in communication with tank 2 by an opening 8. Jack 6 is supplied with air under pressure by means of pipe 9. Rod 10 of piston 11 has secured thereto a plate 13 mounted on guides 14 provided with restoring springs 15 which make it possible automatically to bring piston 11 back to the low position as soon as the gluing operation under pressure has been performed.

After the completion of a gluing operation, the pressurized air is exhausted from beneath piston 11 through pipe 9, the exhaust air then passing into housing 17 from whence it is exhausted by fast acting exhaust valves 18. Housing 17 is shown diagrammatically in FIG. 2. The pressure can vary in rather broad limits, for example, from 3 to 8 bars. If a diameter of 200 mm is used for piston 11, a thrust of 1800 kg is obtained, for an air pressure of 6 bars, which is ample for flexible pocket 5 to fit the shape of the footwear sole 4 perfectly (as shown in the broken line in FIG. 1).

Figure 2:
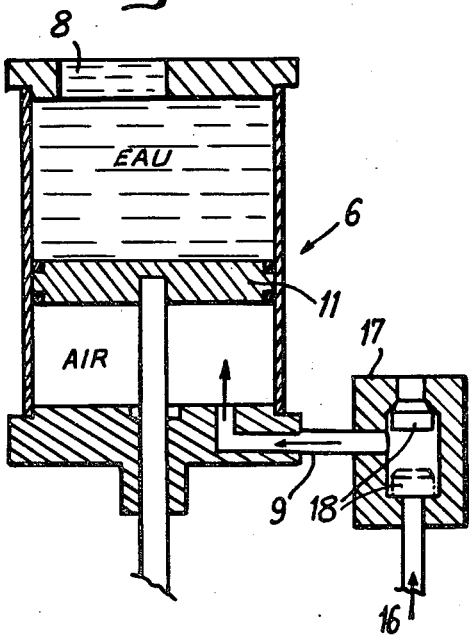
FIG. 2 is a more detailed view of the jack and pressurized air injection chamber.
Figure 3:
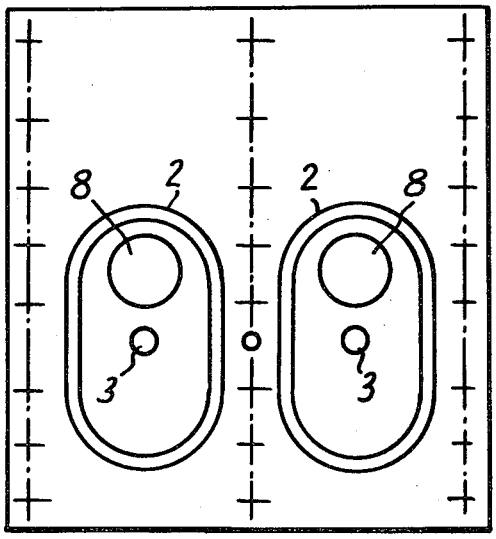
FIG. 3 is a diagram of a top view of two tanks of a press for a pair of footwear intended to contain the sole and the lower part of the upper and the elastic pocket or membrane.

At the beginning, when the press is started tank 2 is filled with water 19 or the equivalent, piston 11 of jack 6 being in the upper position indicated by the broken line in FIG. 1. Build-up of pressure is accomplished by sending pressurized air via conduit 16 into housing 17 from whence the pressurized air passes through pipe 9 into the space beneath piston 11. This forces piston 11 upwardly whereby to force the liquid above piston 11 into the chamber 2 bounded by flexible membrane or pocket 5. This forces flexible pocket 5 to conform to the contour of the footwear elements which are to be glued together, as shown in the broken line in FIG. 1. After release of the air pressure, springs 15 bring the jack to the low position in a very short time. Tank 2 is provided with an air purge 20 for fillings.

In the new system according to the invention, at least 10 seconds is saved in each gluing operation because the water filling and evacuation times are of the order of about two seconds in total, instead of 12 to 14 seconds on the average in a press with a standard hydraulic arrangement. Moreover, the amount of water used is small and the machine frame can be made with significantly smaller dimensions. Finally, it becomes possible, if desired, to eliminate all the electrical parts of a standard press since pumps, motors, fans and similar elements are not used.

Of course, the invention is not limited to the embodiment described hereinbefore and extends to all equivalents with the same technical functions.

What is claimed is:

1. A press for gluing footwear elements to each other comprising a tank, means for supporting an article of footwear in said tank, a flexible pocket adapted to envelope at least the portion of said article of footwear which includes said footwear elements which are to be glued to each other, wherein the improvement comprises a jack including a cylinder and a piston movable in said cylinder, said piston being adapted to be moved by the application of a pressurized pneumatic fluid to one surface of said piston, the opposite surface of said piston communicating with a liquid supply in said tank, whereby movement of said piston is operable to force said liquid under pressure against said flexible pocket to cause said flexible pocket to conform to the contour of the footwear elements which are to be glued to each other whereby to cause said elements to become glued to each other, and means for moving said piston to a retracted position when the pneumatic pressure on said piston is relieved.

2. A press as defined in claim 1 in which said pneumatic fluid is air.

3. A press as defined in claim 1 in which said liquid is water.

4. A press as defined in claim 1 in which said piston includes a piston rod projecting beyond said cylinder, and said means for moving said piston to a retracted position comprises a cross member carried by a portion of said piston rod which projects beyond said cylinder, and spring means engageable with said cross member for normally biasing said piston and said piston rod to a retracted position.

5. A press as defined in claim 1 additionally comprising a housing, valve means in said housing for controlling the discharge of pneumatic fluid from said housing, and conduit means connecting the portion of the interior of said cylinder which communicates with said one surface of said piston to said housing whereby to permit discharge flow of pneumatic fluid from said cylinder to said housing when said piston is being retracted in said cylinder.

6. A press as defined in claim 1 in which said tank is provided with an air purge means.

7. A press as defined in claim 1 in which the amount of liquid employed does not exceed the amount of liquid required to fill said tank.

8. A press as defined in claim 1 in which a surface of said flexible pocket overlies the surface of the liquid in said tank, the article of footwear being positioned contiguous the opposite surface of said flexible pocket, whereby as said liquid under pressure is forced against said flexible pocket, said pocket is caused to conform to the contour of the footwear elements which are to be glued to each other.

9. A press as defined in claim 1 in which said flexible pocket is an elastic membrane.

* * * * *